US012767407B2

(12) United States Patent
Telman

(10) Patent No.: US 12,767,407 B2
(45) Date of Patent: Oct. 20, 2026

(54) TAMPER RESISTANT GIFT CARD CARRIER

(71) Applicant: Christopher Telman, Franklin, TN (US)

(72) Inventor: Christopher Telman, Franklin, TN (US)

( * ) Notice: Subject to any disclaimer, the term of this patent is extended or adjusted under 35 U.S.C. 154(b) by 0 days.

(21) Appl. No.: 19/321,900

(22) Filed: Sep. 8, 2025

(65) Prior Publication Data

US 2026/0070724 A1 Mar. 12, 2026

Related U.S. Application Data

(60) Provisional application No. 63/692,118, filed on Sep. 8, 2024.

(51) Int. Cl.
*B65D 75/36* (2006.01)
*B65D 75/56* (2006.01)
*B65D 75/58* (2006.01)

(52) U.S. Cl.
CPC ..... *B65D 75/366* (2013.01); *B65D 75/566* (2013.01); *B65D 75/5855* (2013.01); *B65D 2575/366* (2013.01)

(58) Field of Classification Search
CPC ..... B65D 75/366; B65D 75/566; B65D 75/5855; B65D 2575/366; B65D 73/0078; B65D 65/14; B65D 73/00; B65D 73/0028; G09F 3/0292
USPC ..... 206/449, 460; 229/102
See application file for complete search history.

(56) References Cited

U.S. PATENT DOCUMENTS

| | | | | |
|---|---|---|---|---|
| 6,349,829 | B1 * | 2/2002 | Matheis | B65D 29/04 206/39 |
| 9,604,489 | B2 * | 3/2017 | Nakagawa | A45C 11/182 |
| 11,214,091 | B2 * | 1/2022 | Pascua | B42D 25/20 |
| 2006/0151348 | A1 * | 7/2006 | Willard | B65D 73/0078 206/806 |
| 2010/0213092 | A1 * | 8/2010 | Swain | B65D 75/20 206/460 |
| 2015/0151890 | A1 * | 6/2015 | Payne | B65D 75/20 156/227 |
| 2016/0046428 | A1 * | 2/2016 | Payne | B65D 75/20 53/445 |
| 2017/0243098 | A1 * | 8/2017 | Pascua | A45C 11/184 |
| 2017/0327289 | A1 * | 11/2017 | Huffer | B65D 75/5844 |

* cited by examiner

*Primary Examiner* — Laura E. Parker
(74) *Attorney, Agent, or Firm* — Comprising IP; Russell D. Nugent

(57) ABSTRACT

A tamper evident gift card carrier or package that includes a card attached to a carrier and with an encapsulating label positioned over the card. The label features a periphery coated with an adhesive and that surrounds a middle section positioned over the card. One or more sets of die cuts or perforations allow easy removal and indicate tampering. The middle section can also feature embossing on the surface that directly faces and/or contacts the label. A second set of perforations or tamper marks is die cut into the periphery of the label such that if that entire label is peeled away from the carrier to which it is attached, the periphery of the label will separate into more than one section making tampering evident. The label can be made of a water-soluble material such as PVOH (polyvinyl alcohol).

17 Claims, 8 Drawing Sheets

TAMPER RESISTANT GIFT CARD CARRIER

CROSS-REFERENCE TO RELATED APPLICATIONS

This Application claims the benefit of priority of U.S. patent application Ser. No. 63/692,118 filed on Sep. 8, 2024. The content of U.S. patent application Ser. No. 63/692,118 filed on Sep. 8, 2024 is incorporated by reference in its entirety.

BACKGROUND OF THE INVENTION

(a) Field of the Invention

The present invention is in the technical field of packaging gift cards. More particularly, the present invention is in the technical field of packaging cards such as gift cards or credit cards.

(b) Background Art

Gift cards are targets for thieves and scammers. Because of the manner in which gift cards are packaged, there are a plethora of ways that people can try to open the packaging and steal the gift card inside.

When packaging a gift card or similar device, typically, the card is attached to a paper-based substrate or "carrier" with an adhesive or double-sided sticker. The carrier is then folded one time over the card and the edges are sealed. There are a variety of different methods of sealing the carrier, but the traditional method is with wet and hot melt adhesives or glues. Traditional methods of sealing the card carrier use spots of adhesive and thus the entire surface area of the carrier around the card is not sealed. This makes it much easier for thieves to insert a cutting tool between the spots of adhesive ("adhesive dots") and cut the adhesive holding the two halves of the carrier together and open the card carrier and stealing the gift card without damaging the carrier enough that people notice. The card carrier then gets glued back together and placed back in displays presented to consumers and the consumer purchases a fake card while the thief pockets the card that was originally placed into the carrier.

The problem presented by this process is that it produces a card located inside a carrier that has multiple edges sealed with some form of adhesive that can be easily defeated using steam, heat, razor blades or a number of other methods designed to compromise the adhesive holding the carrier together. The current methods of packaging gift cards are flawed in that thieves are routinely able to open the packaging, remove and replace the card inside and replace the package without being detected. This leads to an estimated $217 million in losses resulting from card fraud each year. Thieves can also replace the legitimate card with another card to which they have access and when the consumer puts money on the card at the point of purchase, the thief is able to access and steal those funds.

There remains a need in the packaging industry for a means of sealing gift cards inside carriers such that it is evident when someone has attempted to defeat the adhesive and open the card in advance of purchase.

BRIEF SUMMARY OF THE INVENTION

The present disclosure relates to a packaged gift card and a method of making same which a thief cannot remove and replace without damaging the packaging or carrier and thus being detected before the card in the carrier is placed back in a display case for a consumer to buy. In summary, the gift card is attached directly to the carrier via a standard adhesive and a specialized cover or label is placed over the card and attached hermetically to the carrier. The label covers the card attached to the carrier and bonds to an exposed surface of the carrier to which that card is attached. The label has two sides, a first side that covers the card and attaches to the carrier completely encircling and thus encapsulating the card in 360 degrees, i.e. around the entire outer edge of the card and a second side that stays exposed after the package is assembled and frequently has pre-printed material on it for registration and identification such as bar codes and terms of use. The first side includes an adhesive coating covering the entire designated area that surrounds where the gift card will be placed and that attaches the first side of the label to the card carrier. The label does not need to include adhesive over the portion of the first surface that physically covers the card itself, rather, a first surface of the label that features or includes adhesive around the edges or periphery to attach to the carrier and does not have any adhesive on the portion of the first surface that covers and/or comes into contact with the card itself. The label also includes die cuts or perforations that allow the user to tear the label and remove the card. These die cuts or perforations have bridges that also have the effect of allowing the paper label to stretch to accommodate the dimensions and thickness of the card and they also make removing the card more difficult. On the outside edges and along the sides of the label, there are also tamper marks die cut into the label. These tamper marks are cut into the label and cause the label to tear at these cuts along any part of the surrounding portion of the label that is tampered with when part of the label is pulled away from the card carrier. These cuts cause the label to separate into more than one piece that cannot be placed back onto the carrier in exactly the same place if and when someone tries to peel the a portion of the label away from the rest of the card carrier. When someone does so, portions of the label stay adhered to the carrier and portions of it peel away; if someone then tries to lay the label back down on the carrier, the label on either side of the tamper marks will not properly align making it very evident that someone has opened it or at least attempted to open the package. In the unlikely event that someone manages to defeat the permanently tackified (dried) adhesive that completely encircles the card, they will not be able to reattach the label to the card so that the portions of the label on either side of the tamper die cuts will lay flush, i.e. it will be evident to anyone looking at the package that it was already opened.

Preferred embodiments and the inventor's anticipated best mode include a label made of a material that is dissolvable in water such as PVOH (Polyvinyl Alcohol) so that thieves using water or steam to try to tamper with the gift card carrier will not be able to hide their efforts at deception.

In addition, the portion of the label that directly covers the card itself can be embossed to accommodate the thickness of the card. Embossing the surface of the label allows the outer edge of the label to lay flat as the middle section rises higher to accommodate the card's presence. This makes assembling the card carrier easier as the label moves over the card more easily and lays down easier on the surface of the carrier.

DETAILED DESCRIPTION OF THE INVENTION

Figure 1:
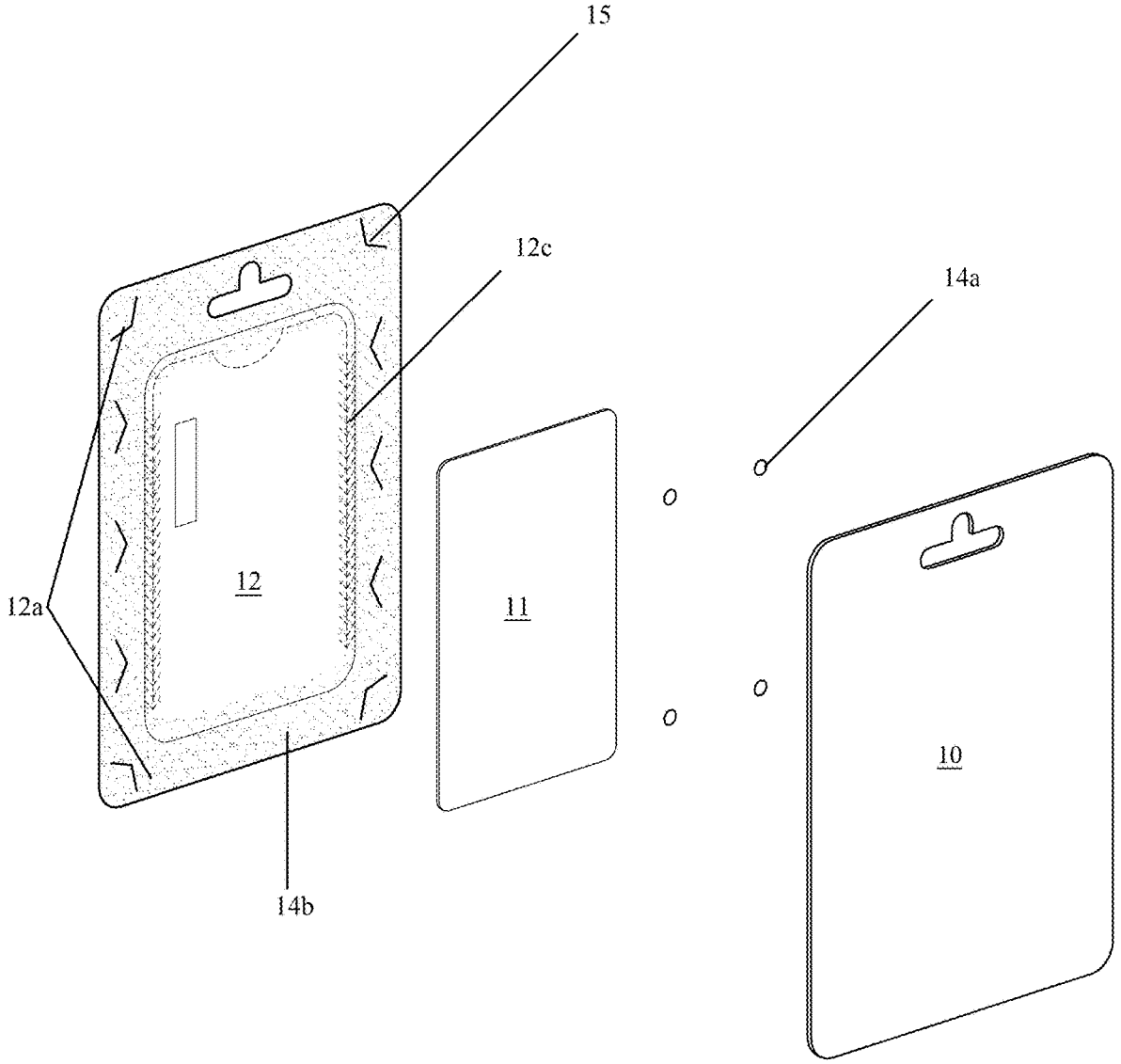
FIG. 1 is an exploded view of the inventive label, a gift card and a card carrier.
Figure 2:
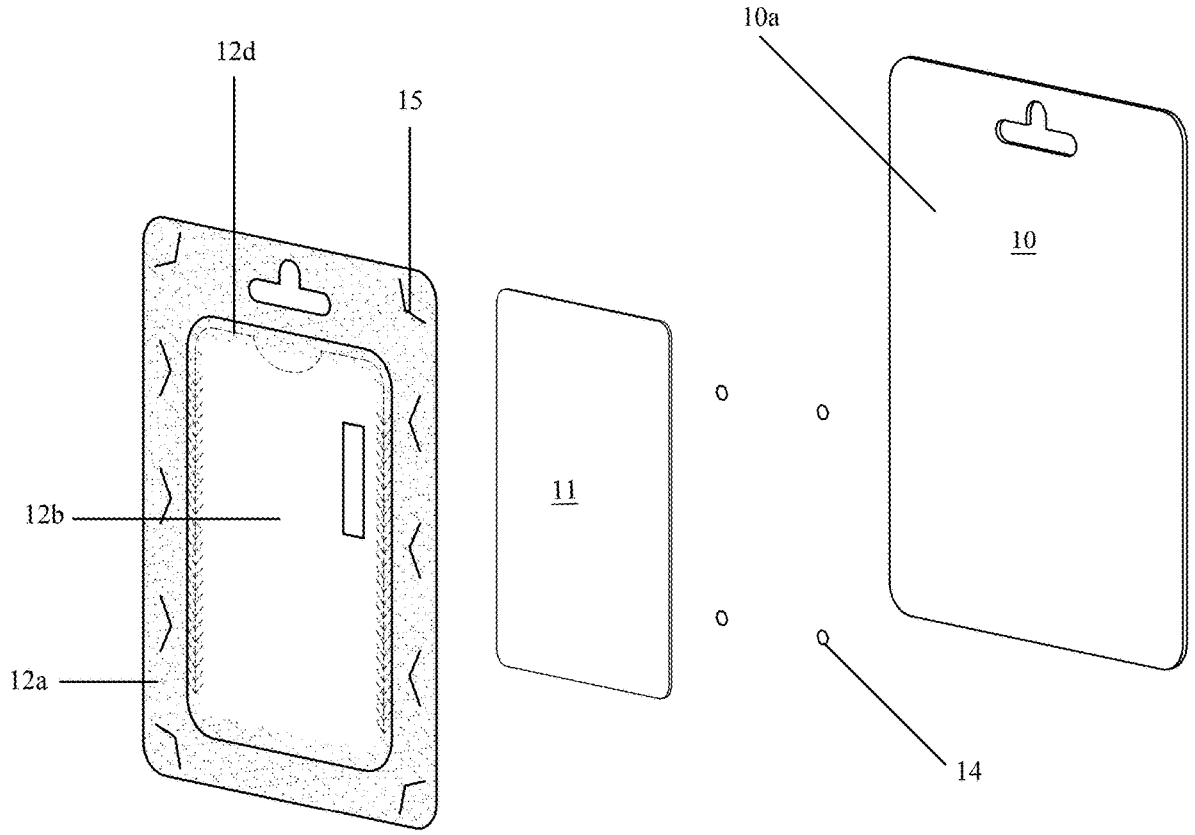
FIG. 2 is an exploded view thereof from the opposite angle.

FIGS. 1 and 2 show an exploded view of the assembled carrier 10, card 11 and label 12 from opposing angles. The method of packaging a gift card includes attaching the gift card 11 itself to a card carrier 10. The card carrier 10 itself is a flattened, two-sided, paper-based substrate to which the gift card 11 is attached with an adhesive 14*a* or a double-sided sticker. The label 12 can be made of any number of different materials including paper or plastic based materials that are capable of adhering to the carrier 10 with a permanent adhesive. As discussed above, preferred embodiments include a material that dissolves in water such as Polyvinyl Alcohol. The first side of the label 12 incudes a periphery 12*a*, fully coated with an adhesive 14*b*, that encircles a middle section 12*b* that is positioned directly over the card 11 once it is attached to the carrier 10. The middle section 12*b* of the label 12 does not have any adhesive on it so when it is placed over the card 11 it does not adhere to the card itself. The periphery 12*a* of the label 12 is fully coated with an adhesive 14*b* so that when it is placed onto a front or first surface 10*a* of the carrier 10, the periphery adheres to the carrier 10 completely encapsulating and encircling the card 12 with surfaces attached by adhesive. When assembled, the label 12 is hermetically secured to the carrier 10 such that the entire package is sealed around the card 11 contained therein. There are no spots or sections of the periphery 12*a* that are not attached to the card carrier 10 with adhesive, i.e. the card 11 is completely sealed into the packaging rather than there being gaps in the adhesive 14*b* attaching the periphery 12*a* to the carrier. At that point, the first side of the label 12 is not visible as it is adhered to the carrier 10 and the second side fo the label 12 is visible to anyone viewing the assembled carrier.

FIGS. 1 and 2 also show that the label 12 includes a periphery 12*a* with a section 12*c* that has die cuts and/or perforations 12*d* around the middle section 12*b* of the label 12 that encircle the gift card 11 once the label 12 is positioned on and adhered to the carrier 10. These die cuts or perforations 12*d* are meant to be torn by the consumer when the package is opened as intended.

Figure 3:
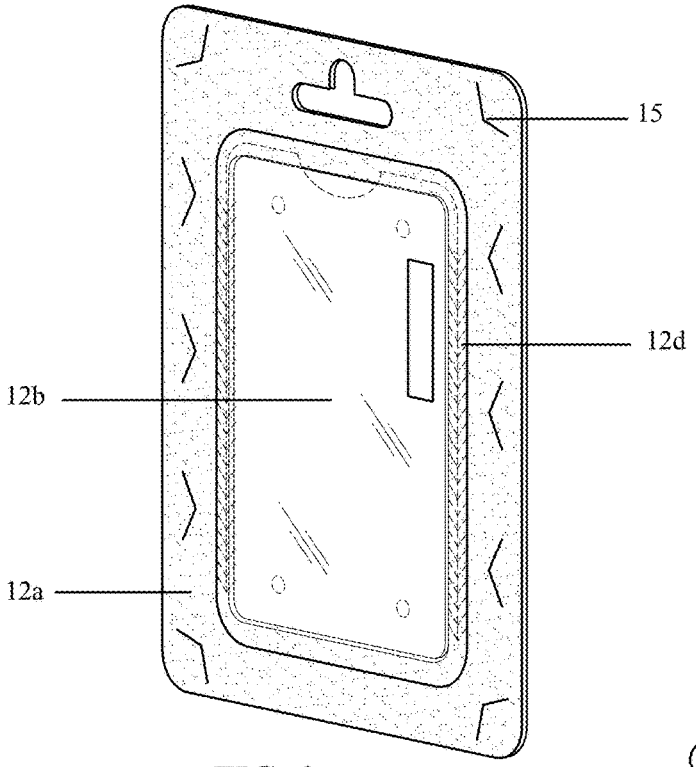
FIG. 3 is a perspective view of the assembled gift card carrier with a label attached to a carrier covering the card.
Figure 4:
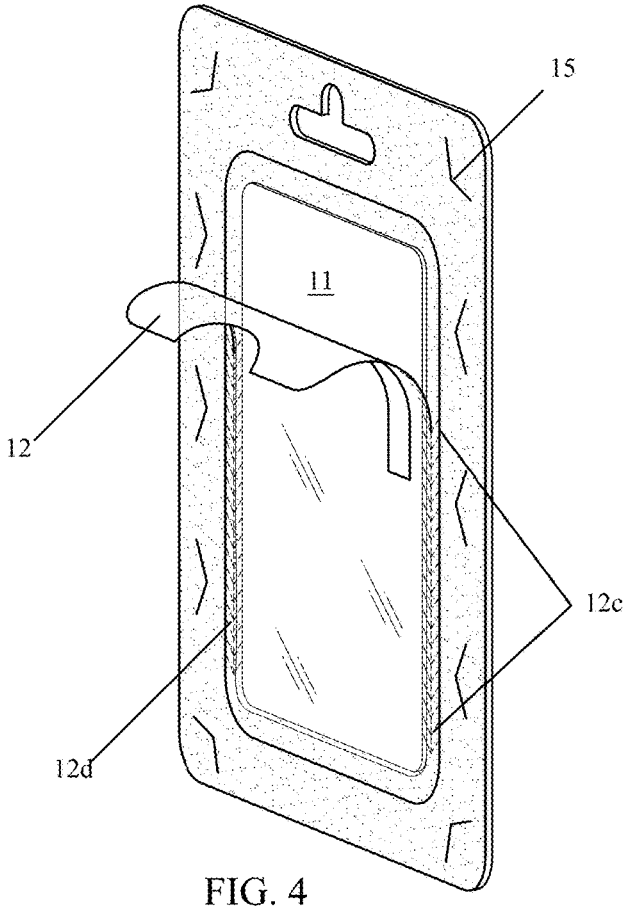
FIG. 4 is a perspective view of the same label with a portion of it being removed to allow access to the gift card as intended.

FIGS. 3 and 4 show how the gift card 11 is removed from the fully assembled package. The user tears the label 12 by tearing the die cuts and/or perforations 12*d* in the perforated section 12*c* of the label 12 and peeling it partially away from the carrier 10 allowing access to the card 11 itself. It is simply not possible to access the card in this configuration without damaging the die cut and/or perforated section of the label and thus signaling that the package has been tampered with.

Figure 5:
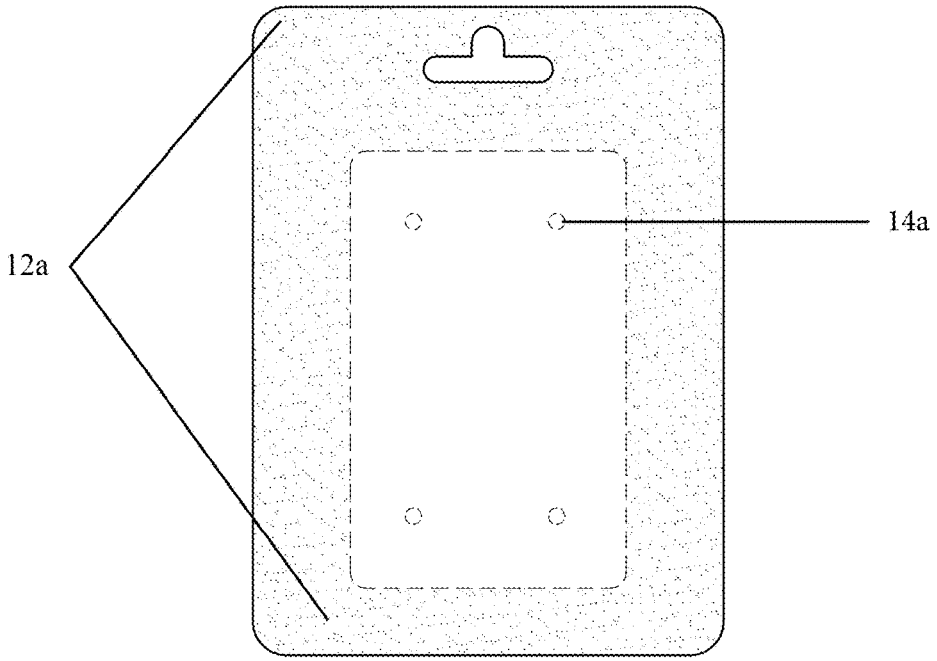
FIG. 5 is rear plan view of the assembled carrier with the packaged card.
Figure 6:
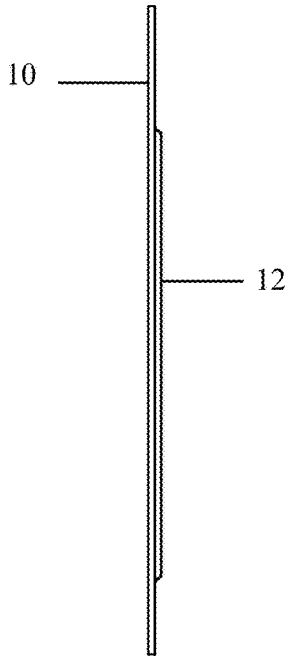
FIG. 6 is a side view thereof showing how the bridged or embossed label hovers over and entraps the gift card.
Figure 7:
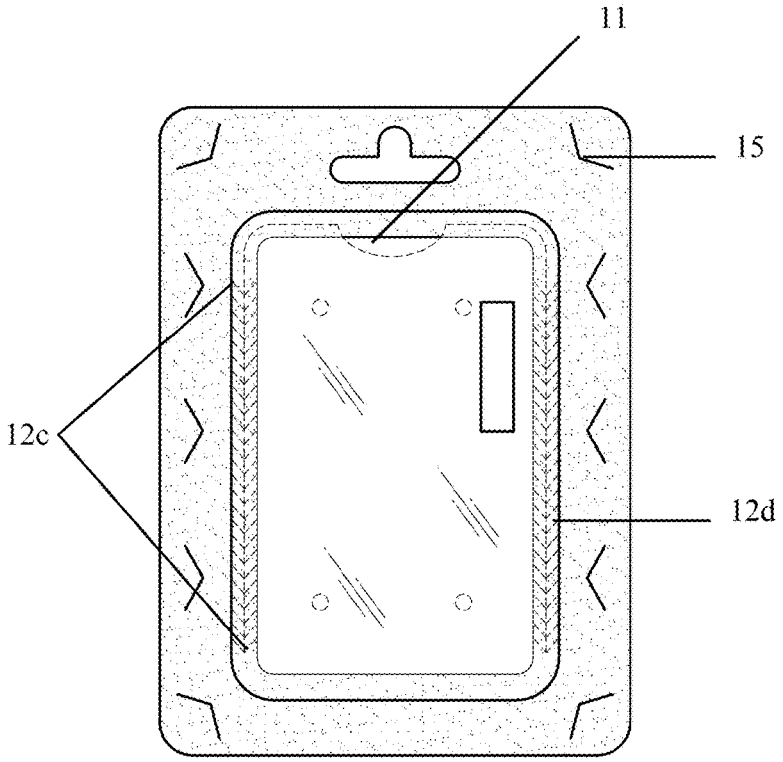
FIG. 7 is a front plan view thereof.
Figure 8:
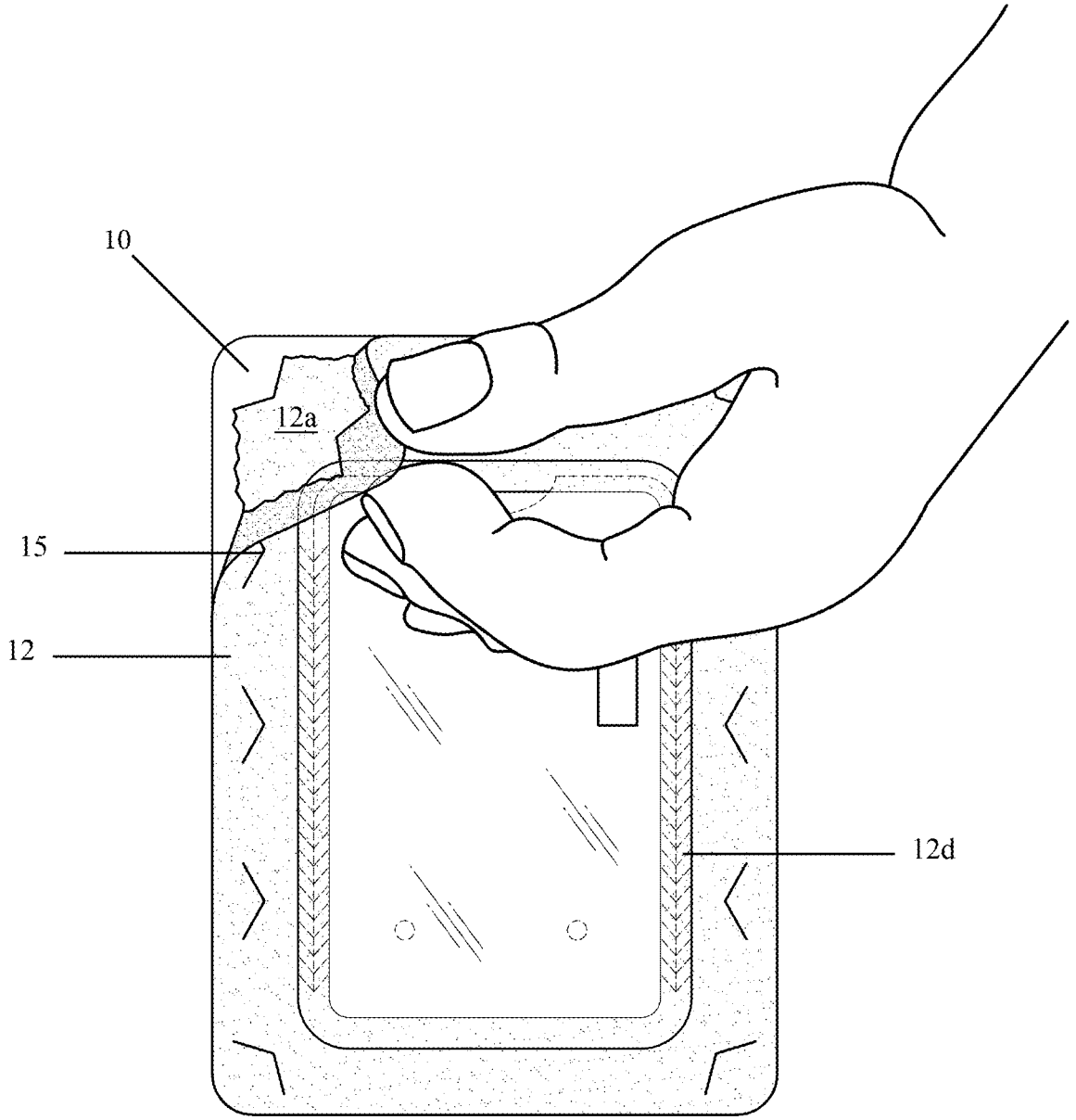
FIG. 8 is a perspective view of the label showing the tamper die cuts cut into the periphery of the label that indicate tampering.

FIGS. 5, 6 and 7 show the assembled package from different angles. FIG. 8 demonstrates the use of the tamper marks 15 which are die cut into the periphery 12*a*. These perforations or tamper marks 15 are separate from the perforations of the perforated section 12*c* that encircle the card 11 attached to the carrier 10. These tamper marks cause the periphery 12*a* of the label 12 to separate into at least two pieces when the label 12 is pulled away from the carrier 10. That way if the adhesive that holds the label 12 to the carrier 10 is compromised in some manner, a feat which is more difficult when the label is coated with adhesive, the periphery 12*a* of the label will separate into at least two pieces. This separation will defeat the thief's ability to replace the label such that the periphery 12*a* of the label lays correctly thereby hiding the replacement of the card inside and their tampering with the carrier.

Figure 9:
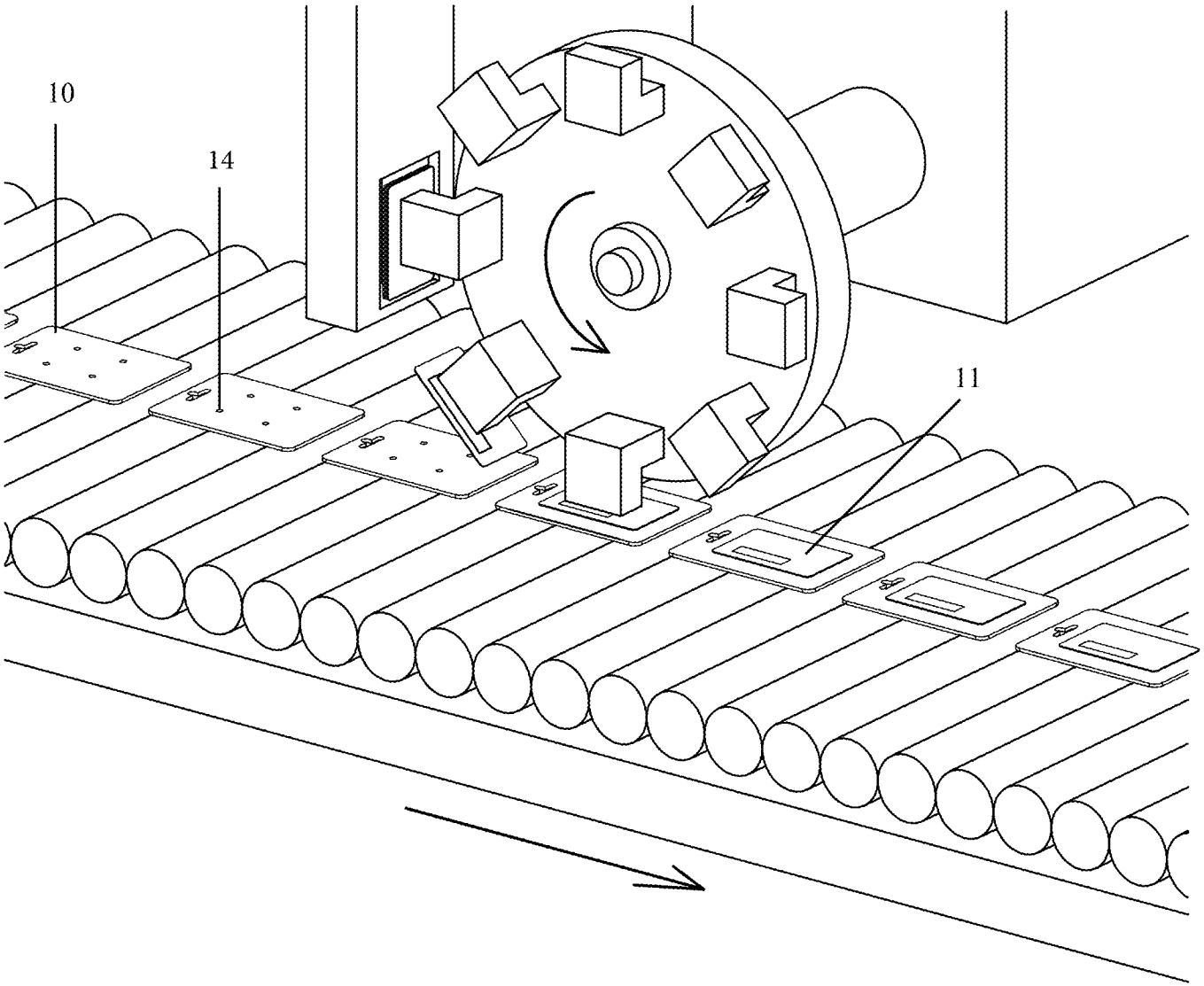
FIG. 9 shows the automated process of attaching the gift card to the carrier
Figure 10:
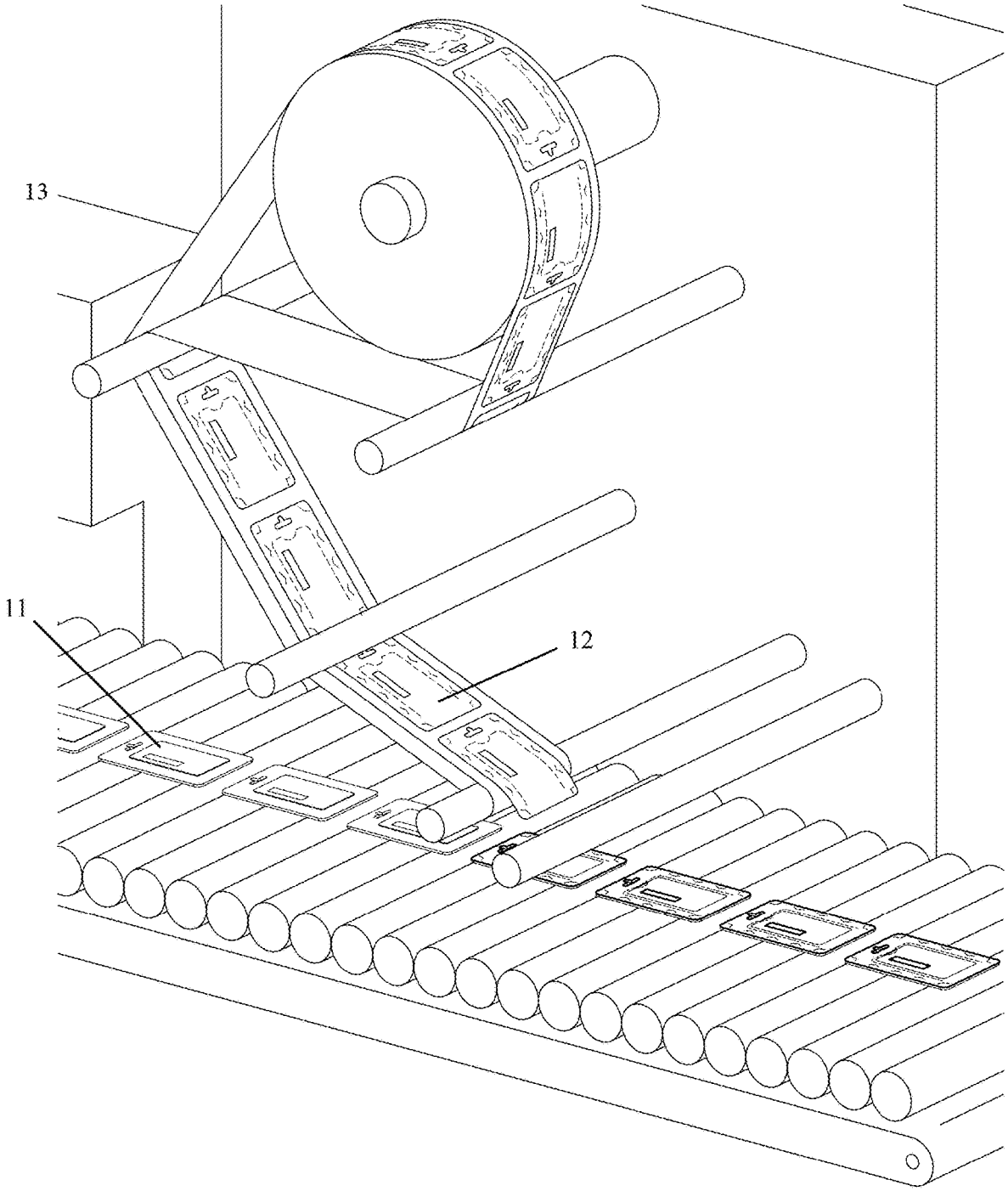
FIG. 10 shows the automated process of attaching the label to the carrier.
Figure 11:
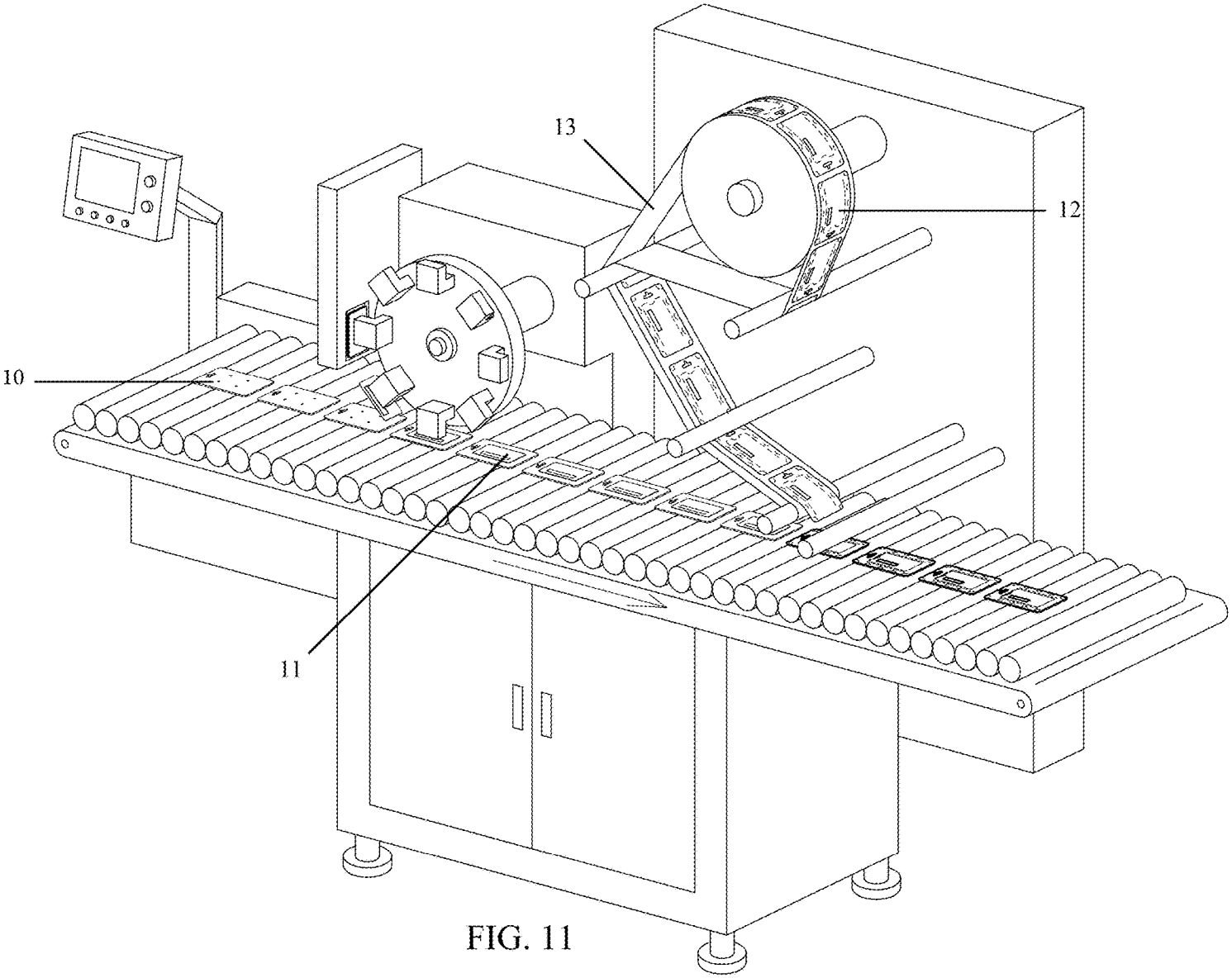
FIG. 11 shows an example of an extended inline assembly of the glue, gift card and label.

FIGS. 9, 10 and 11 show the process of making the assembled package. The card 11 is attached to the carrier 10 with adhesive 14*a* by a wheel or similar machine that positions the card 11 on the carrier 10 after the adhesive 14*a* is added to the carrier 10. The carrier 10 with the attached card 11 is then moved into position underneath another set of rollers that peels a label 12 away from a release liner 13 and rolls the label onto the carrier 10. Once separated from the release liner 13, the labels 12 are rolled and pressed onto the front surface 10*a* of the carrier 10 featuring the attached gift card 11.

The disclosed method and apparatus allow businesses to more securely package gift and other types of cards in disposable packages such that it is evident to a purchaser when the package has been tampered with prior to purchase. The disclosed gift card carrier and system include a label that is sealed over a gift card attached to a gift card carrier such that every edge of the card is surrounded by adhesive attaching the label to the carrier. Preferred embodiments include two sets of die cuts and/or perforations that can partially or completely surround the card attached to the carrier when the label is in place. One set facilitates opening the package as intended and the other set signals to the consumer that someone has tampered with the package by trying to remove the label. The label contains bridges (spaces between perforations and/or die cuts) that allow the label to stretch and create room for the gift card at the same time the periphery of the label lies flat on the carrier.

Example 1. A tamper evident gift card carrier comprising a gift card with a first surface that is adhered to a first surface of the carrier; a label with a first side, a second side and a periphery that completely surrounds a middle section of the label; wherein the periphery of the first side of the label is completely coated with an adhesive and is attached to the first side of the carrier such that the middle section is positioned over the gift card and every edge of the gift card is completely surrounded by the adhesive coated onto the periphery of the first side of the label.

Example 2. The carrier of Example 1 further comprising a first set of set of die cuts and/or perforations, that vary in shape and orientation, cut into a second side of the label that cause the label to separate into more than one piece when the label is peeled away from the gift card carrier.

Example 3. The gift card carrier of Example 2 further comprising a second set of die cuts and/or perforations that cause the label to stretch to accommodate the thickness of the gift card.

Example 4. The carrier of Example 3 wherein the middle section of the first side of the label is embossed and said embossed middle section is positioned over the card attached to the carrier thereby decreasing the amount of friction between the middle section of the label and the gift card during assembly of the gift card carrier.

Example 5. The gift card carrier of Example 4 wherein the periphery of the first side of the label is hermetically sealed to the first side of the gift card carrier.

Example 6. The gift card carrier of Example 5 wherein the first set of die cuts and/or perforations is in the periphery of the second side of the label.

Example 7. The gift card carrier of Example 6 wherein the second set of die cuts and/or perforations define the edges of the middle section.

Example 8. A tamper evident gift card carrier comprising a gift card having a first side, a second side and four edges; the first side of the gift card being attached to the carrier via an adhesive; and a label with a first side partially coated with an adhesive; said label being attached to the gift card carrier such that the adhesive on the first side of the label completely surrounds the four edges of the gift card.

Example 9. The tamper evident gift card carrier of Example 8 further comprising a set of die cuts and/or perforations cut into the label and that completely traverse the label from the first side of the label to a second side of the label such that if the label is separated from the gift card carrier, the label to separate into more than one piece.

Example 10. The tamper evident gift card carrier of Example 8 further comprising a set of die cuts and/or perforations that encircle the gift card that allow the label to stretch to accommodate the dimensions of the gift card.

Example 11. The tamper evident gift card carrier of Example 8 further comprising a middle section defined by and encircled by the periphery of the label; said middle section having no adhesive and being positioned to contact the gift card when the label is attached to the gift card carrier.

Example 12. The tamper evident gift card of Example 11 wherein the middle section of the first side of the label is embossed and said embossed middle section is positioned over the gift card attached to the carrier thereby decreasing the amount of friction between the middle section of the label and the gift card during assembly of the gift card carrier.

Example 13. The tamper evident gift card carrier of Example 8 wherein the periphery of the first side of the label is hermetically sealed onto the gift card carrier resulting in the gift card being surrounded on all sides by the adhesive, the label and the gift card carrier.

Example 14. A tamper evident gift card carrier comprising a gift card having a first side, a second side and four edges; a label with a first side and a second side wherein each side of the label has a periphery surrounding a middle section; an adhesive applied to the periphery of the first side of the label; said periphery of the first side of the label being attached to a surface of the gift card carrier such that the four edges of the gift card are surrounded by said adhesive; the first side of the gift card being attached to the carrier via an adhesive; and said label being attached to the gift card carrier such that the adhesive on the first side of the label completely surrounds the four edges of the gift card, the label covers the second side of the gift card and the gift card carrier covers the first side of the gift card.

Reference throughout the specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout the specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

It is understood that the above-described embodiments are only illustrative of the application of the principles of the present invention. The present invention may be embodied in other specific forms without departing from its spirit or essential characteristics. The described embodiment, including the best mode, is to be considered in all respects only as illustrative and not restrictive. The scope of the invention is, therefore, indicated by the appended claims, if any, in conjunction with the foregoing description.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

The invention claimed is:

1. A tamper evident gift card carrier comprising:

a gift card with a first surface that is adhered to a first side of the gift card carrier;

a label with a first side and a second side wherein the first side has a periphery that completely surrounds a middle section of the label; wherein the periphery of the first side of the label is completely coated with an adhesive and is attached to the first side of the carrier such that the middle section is positioned over the gift card and every edge of the gift card is completely surrounded by the adhesive coated onto the periphery of the first side of the label;

a first set of die cuts and/or perforations, that vary in shape and orientation, cut into the label that cause the label to separate into more than one piece when the label is peeled away from the gift card carrier; and a second set of die cuts and/or perforations with bridges that cause the label to stretch to accommodate the thickness of the gift card.

2. The gift card carrier of claim 1 wherein the middle section of the first side of the label is embossed and said embossed middle section is positioned over the card attached to the carrier thereby decreasing the amount of friction between the middle section of the label and the gift card during assembly of the gift card carrier.

3. The gift card carrier of claim 2 wherein the periphery of the first side of the label is hermetically sealed to the first side of the gift card carrier.

4. The gift card carrier of claim 3 wherein the first set of die cuts and/or perforations is in the periphery of the second side of the label.

5. The gift card carrier of claim 4 wherein the second set of die cuts and/or perforations define the edges of the middle section.

6. The tamper evident gift card carrier of claim 1 wherein the label is made of a water-soluble material.

7. The tamper evident gift card carrier of claim 6 wherein the water-soluble material is polyvinyl alcohol.

8. A tamper evident gift card carrier comprising:

a gift card having a first side, a second side and four edges; the first side of the gift card being attached to the carrier via an adhesive;

a label with a first side partially coated with an adhesive; said label being attached to the gift card carrier such that the adhesive on the first side of the label completely surrounds, but does not contact or cover the four edges of the gift card; and a set of die cuts and/or perforations that encircle the gift card and include bridges that allow the label to stretch to accommodate the dimensions of the gift card.

9. The tamper evident gift card carrier of claim 8 further comprising:

a second set of die cuts and/or perforations cut into the label and that completely traverse the label from the first side of the label to a second side of the label such that if the label is separated from the gift card carrier, the label will separate into more than one piece.

10. The tamper evident gift card carrier of claim 8 further comprising:

a middle section defined by and encircled by a periphery of the label; said middle section having no adhesive and being positioned to contact the gift card when the label is attached to the gift card carrier.

11. The tamper evident gift card carrier of claim 10 wherein the middle section of the first side of the label is embossed and said embossed middle section is positioned over the gift card attached to the carrier thereby decreasing the amount of friction between the middle section of the label and the gift card during assembly of the gift card carrier.

12. The tamper evident gift card carrier of claim 8 wherein a periphery of the first side of the label is hermetically sealed onto the gift card carrier resulting in the gift card being surrounded on all sides by the adhesive, the label and the gift card carrier.

13. The tamper evident gift card carrier of claim 8 wherein the label is made of a water-soluble material.

14. The tamper evident gift card carrier of claim 13 wherein the water-soluble material is polyvinyl alcohol.

15. A tamper evident gift card carrier comprising:

a gift card having a first side, a second side and four edges;

a label with a first side and a second side wherein each side of the label has a periphery surrounding a middle section;

an adhesive applied to the periphery of the first side of the label;

said periphery of the first side of the label being attached to a surface of the gift card carrier such that the four edges of the gift card are surrounded by adhesive; a set of die cuts and/or perforations cut into the label that encircle the gift card and include bridges that allow the label to stretch to accommodate the dimensions of the gift card;

the first side of the gift card being attached to the carrier via an adhesive; and said label being attached to the gift card carrier such that the adhesive on the first side of the label completely surrounds the four edges of the gift card, the label covers the second side of the gift card and the gift card carrier covers the first side of the gift card.

16. The tamper evident gift card carrier of claim 15 wherein the label is made of a water-soluble material.

17. The tamper evident gift card carrier of claim 16 wherein the water-soluble material is polyvinyl alcohol.

* * * * *